US006908049B2

(12) United States Patent
Deluca

(10) Patent No.: US 6,908,049 B2
(45) Date of Patent: Jun. 21, 2005

(54) DIESEL INJECTION NOZZLE

(75) Inventor: Frank Deluca, Enfield, CT (US)

(73) Assignee: Alfred J. Buescher, Shaker Heights, OH (US)

( * ) Notice: Subject to any disclaimer, the term of this patent is extended or adjusted under 35 U.S.C. 154(b) by 25 days.

(21) Appl. No.: 10/713,243

(22) Filed: Nov. 14, 2003

(65) Prior Publication Data

US 2005/0103898 A1 May 19, 2005

(51) Int. Cl.[7] ..... F02M 61/00

(52) U.S. Cl. ..... 239/533.12; 239/533.3; 239/533.8; 239/88; 251/333

(58) Field of Search ..... 239/533.3, 533.8, 239/533.12, 584, 88, 98, 585.1; 251/129.14, 251/333

(56) References Cited

U.S. PATENT DOCUMENTS

| | | | | |
|---|---|---|---|---|
| 2,927,737 | A * | 3/1960 | Werner et al. | 239/533.3 |
| 3,980,237 | A * | 9/1976 | Parrish, Jr. | 239/533.3 |
| 5,033,679 | A * | 7/1991 | Golev et al. | 239/533.3 |
| 5,467,924 | A | 11/1995 | Buescher | |
| 5,725,157 | A | 3/1998 | DeLuca | |
| 6,007,000 | A | 12/1999 | DeLuca | |
| 6,491,237 | B1 | 12/2002 | Coppola et al. | |

* cited by examiner

*Primary Examiner*—Dinh Q. Nguyen
(74) *Attorney, Agent, or Firm*—Pearne & Gordon LLP

(57) ABSTRACT

An annular notch is provided in the body seat associated with the nozzle valve of an ALCO-type diesel injector. The notch extends from (i) an upper edge that is on the seat and is above the imaginary edge that would have been the sac inlet edge had the notch not been provided to (ii) a lower edge below such imaginary edge. The notch has a lowest wall that, at least at the portion of its length where such lowest wall approaches such lower edge, has a given angle-to-vertical of less than 60°.

6 Claims, 2 Drawing Sheets

DIESEL INJECTION NOZZLE

FIELD OF THE INVENTION

This invention relates generally to fuel injection systems for diesel engines, and particularly to systems employing fuel injectors of the type known as ALCO injectors, originally manufactured by American Bosch for the former American Locomotive Company. Such systems comprise an injection pump, a nozzle-and-holder assembly, and high-pressure tubing joining the pump to the assembly.

BACKGROUND OF THE INVENTION

In recent years the diesel engine industry has been under continuing pressure to reduce noxious emissions without unduly sacrificing fuel efficiency, or even while improving fuel efficiency. Engine emissions performance has improved, while maintaining acceptable fuel efficiencies, but pressure for further improvements remains.

An important element in these improvements is the modification of existing designs of diesel injection systems, particularly modification of existing injection nozzle-and-holder assemblies, especially the nozzles. In the never-ending pursuit of reduced exhaust emissions and improved fuel economy, modern fuel injection systems are operating at injection pressures considerably above those prevailing when ALCO injectors were introduced, and industry efforts are continuing to develop systems for still higher injection pressures. While it is not economically feasible to retrofit older engines with newer injection technologies, it is possible to make improvements in components of injection systems used with older engines and thereby increase to a meaningful extent the injection pressure at the nozzle orifices.

ALCO nozzle-and-holder assemblies and nozzles are a notable example of such systems. Similarly to some other older systems, those employing ALCO nozzles generally include a nozzle body, in which a nozzle body chamber is formed. The nozzle body terminates in a nozzle tip and houses a nozzle valve. The seat on which the nozzle valve closes is formed in the nozzle body at the bottom of the nozzle body chamber and is open-centered. It may be referred to as the body seat. Lower parts of the body seat lie in an imaginary conical surface. Below the nozzle body chamber is a small spray-hole feed chamber or "sac." The spray holes, or orifices, are distributed around the sac and lead to the engine combustion chamber when the nozzle is installed.

One consideration in the design of such systems is the seat/orifice ratio, namely, the ratio, at full valve lift, between (i) the governing or minimum flow area at the body seat and (ii) the collective cross-sectional area of the spray holes. Lower seat/orifice ratios are associated with higher pressure drops through the body seat and lower injection pressures at the nozzle orifices, with a resultant degeneration of fuel penetration and fuel dispersion in the engine cylinder. Seat/orifice ratios over 2 or not too far below 2 are generally considered acceptable, while lower ratios are not. However, in certain high rated engines, when the orifice area required for the engine power rating gets to be too large for the nozzle size accommodated in the engine cylinder head, the seat/orifice ratio is considered not excessively restrictive down to 1.5, and in extreme cases is compromised down to 1.35.

In a rudimentary sense, the measure or value of the minimum flow area at the body seat depends on the sac diameter, since the minimum flow area at the body seat, when the valve is at full-lift position, is located adjacent the sac entry edge, where the side wall of the sac intersects the conical lower part of the body seat.

Increasing valve lift would of course increase minimum flow area at full lift, but there are well-known constraints on increasing lift, such as body seat impact damage and coordination of valve seating and engine stroke phases in high-rated engines.

Where good practice calls for increasing the seat/orifice ratio of an ALCO-type nozzle design without increasing valve lift, one way to do it is simply to enlarge the sac diameter, which has the effect of raising the altitude of the intersection between sac wall and body seat, thereby causing the unchanged spacing, at that raised altitude, between valve and body seat at full lift to sweep a greater circumference than at the lower altitude that previously applied, correspondingly increasing the minimum flow area at the body seat, thereby in turn increasing the seat/orifice ratio. It was recognized however, that such a modification of the ALCO nozzle would have a major disadvantage in that sac volume would be substantially increased by enlarging the sac diameter along the length of the sac, thereby tending to correspondingly degrade emissions performance.

In a case such as this when it is determined that the flow area through the seat is too small for the total nozzle orifice area, universal industry practice has been to reshape the sac in the region of its entry edge with a counter-boring tool having a 120° cutting edge bottom, so that the resulting counter-bore intersects the body seat at the raised altitude referred to above and forms an annular notch extending from the raised altitude referred to above to a level below the lower altitude referred to above—sufficiently below that there is little or no more restriction of flow at the bottom of the notch than at the top. While this modification has increased seat/orifice ratio while somewhat minimizing increase in sac volume, it has done nothing to reduce sac volume and improve emissions performance in that way. Moreover, even if sac volume had been reduced, as by foreshortening the sac, the configuration of the notch was such as to limit to some degree the effectiveness of such foreshortening in reducing emissions.

The present invention does contemplate reduction of sac volume by foreshortening of the sac. The present invention also involves annularly notching the body seat and sac wall to increase the seat/orifice ratio. However, according to the present invention, the notch is configured so that it detracts from the sac-volume-reducing effectiveness of the foreshortening of the sac to a much lesser degree than the above-described conventional type counter-bored notch would have if ALCO's sac had been foreshortened, or at least to a somewhat lesser degree, depending on the specific novel notch configuration selected.

The invention realizes these results by exploiting the geometrical fact that for solids generated by revolution of a polygon of given area (sweep area) around an axis in the same plane, relatively small percentage reductions of sweep area caused by trimming the radially outer side of the sweep area result in significantly larger percentage reductions of swept volume. This means that, in an injection nozzle, a relatively small percentage reduction in the sac's cross-section at its radially outermost parts results in a significantly greater percentage reduction in sac volume.

The improvements of the invention will be more fully understood from the following detailed description of the invention.

BRIEF DESCRIPTION OF THE DRAWINGS

FIG. 6 is rendered on the same enlarged scale as FIG. 4.

FIG. 11 shows parts of the same structure shown in FIG. 9, while FIGS. 10 and 12 show variants thereof.

DETAILED DESCRIPTION OF THE INVENTION

Figure 1:
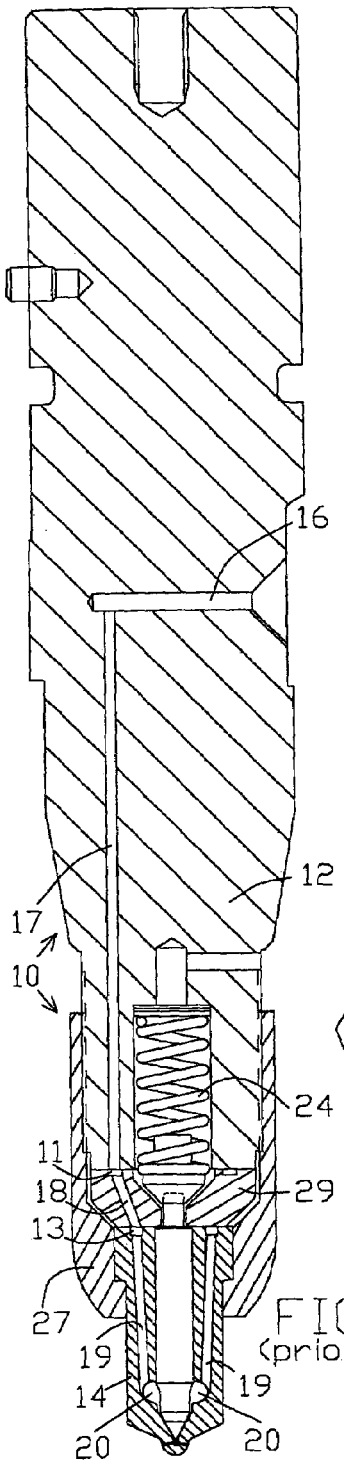
FIG. 1 (prior art)
FIG. 1 is a cross-sectional view of a prior-art ALCO nozzle-and-holder assembly.

An injection system employing an ALCO-type injector comprises an injection pump (not shown), high-pressure tubing (not shown) and a nozzle-and-holder assembly 10 shown in FIG. 1. This assembly is secured in the cylinder head of the engine. It includes the holder 12 and the nozzle body 14. The nozzle body, together with the valve stop spacer 29, is clamped on the holder 12 by the nozzle securing nut 27, the latter being threadedly engaged with the holder 12, all as seen in FIG. 1. The high-pressure tubing connects the pump high-pressure fuel delivery outlet to the inlet duct 16.

When injection pump port closing occurs, a pressure wave is generated delivering fuel through the high-pressure tubing to the inlet duct 16. The pressure wave travels through duct 16, duct 17, annular groove 11 formed in the top face of valve stop spacer 29, ducts 18 (of which there are three, spaced 120° apart, only one being visible in FIG. 1), annular groove 13 formed in the top face of nozzle body 14, ducts 19 (of which there are four, consisting of two diametrically opposed pairs, only one pair being visible in FIG. 1), and into the annular nozzle-body cavity or chamber 20 where the pressure wave acts on the conical differential area 22 (FIG. 2) to lift or open the nozzle valve 15 against the bias of the valve spring 24. Fuel flows into the sac 21 (FIG. 3) and into the nozzle orifices or spray holes 23 and injection begins. The valve stays lifted during the time fuel is being delivered by the pump. When fuel delivery by the pump ceases, a negative pressure wave is generated toward the injection pump, dropping the pressure in the nozzle-body chamber 20 and causing the valve 15 to close, at which time injection ends.

The spray holes may be typically nine in number. A pair from the nine is shown in the drawings, the drawing sections being slightly rotated to include both of the pair as though their centers were 180° apart, although actually they are 160° apart. The remaining seven holes are not shown.

Figure 2:
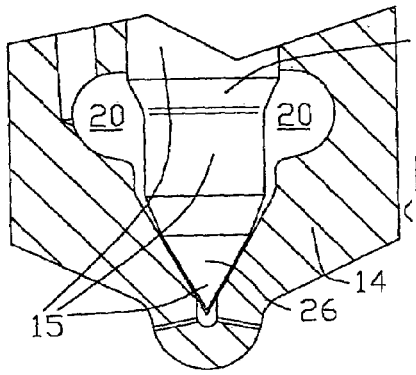
FIG. 2 (prior art)
FIG. 2 is a broken-away view on an enlarged scale of the lower part of the nozzle seen in FIG. 1.
Figure 3:
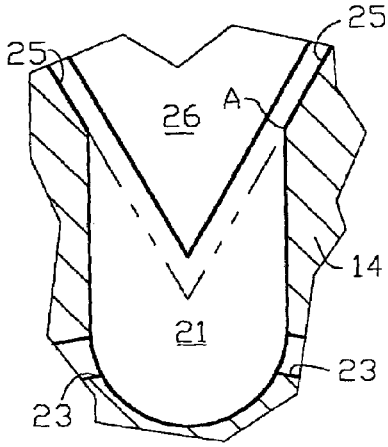
FIG. 3 (prior art)
FIG. 3 is a fragmentary view on a further enlarged scale of the sac of the nozzle seen in FIG. 2 together with adjacent elements or portions thereof.
Figure 4:
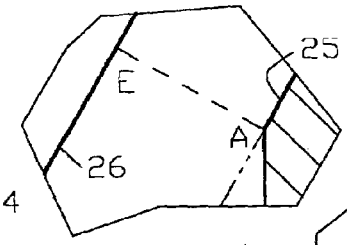
FIG. 4 (prior art)
FIG. 4 is a fragmentary view on a still further enlarged scale showing part of the structure seen in FIG. 3.

The valve seat on the valve 15 is the conical bottom face 26 of the valve (FIGS. 2, 3). The cooperating seat on the nozzle body 14 is the open-centered body seat 25 (FIG. 3). The body seat 25 is at the bottom of the nozzle-body chamber 20. Upper parts of the wall of the sac 21 lie in an imaginary cylindrical surface and lower parts of the body seat lie in an imaginary conical surface that is coaxial with such cylindrical surface. Such conical and cylindrical surfaces intersect each other at a circular intersection seen as point A in FIG. 4. In the structure shown in FIGS. 1–4, this circular intersection is a physical edge forming the entry edge of the sac 21.

In the structure of FIGS. 1–4, when the nozzle valve 15 is raised to the point of maximum lift as shown in solid lines in FIG. 3, line AE (FIG. 4) represents the shortest distance between point A and the conical valve seat 26. The flow area generated by rotation of a sweep line, such as line AE, around the central axis of the nozzle may be calculated from the formula $$a=\pi s(r_1+r_2)$$

where a=flow area, s=length of sweep line, $r_1$=the radial distance from one end of the sweep line to the nozzle's central axis, and $r_2$=the radial distance from the other end of the sweep line to the nozzle's central axis.

While points above point A on the body seat 25 are spaced exactly or about the same distance from the face 26 as is the point A, and therefore sweep lines associated with such higher points are of exactly or about the same length as line AE, such higher points and sweep lines are associated with radii greater than radius 1 and radius 2, and therefore are associated with flow areas greater that that associated with point A. The flow area associated with point A (i.e., with line AE) is therefore the minimum cross-sectional flow area at the body seat, i.e., the minimum flow area for fluid passing from the chamber 20 to the sac 21.

As stated above, where good practice calls for increasing the seat/orifice ratio of a prototype nozzle design, one way to do it is simply to enlarge the sac diameter, which has the effect of raising the altitude of the intersection between sac wall and body seat, thereby causing the unchanged spacing, at that raised altitude, between valve and body seat at full lift to sweep a greater circumference then at the lower altitude that previously applied, correspondingly increasing the minimum flow area at the body seat, thereby in turn increasing the seat/orifice ratio. As also previously stated, it was recognized, however, that such a modification of the prototype nozzle would have a major disadvantage in that sac volume would be greatly increased by enlarging the sac diameter along the sac length, thereby tending to correspondingly degrade emissions performance.

Figure 5:
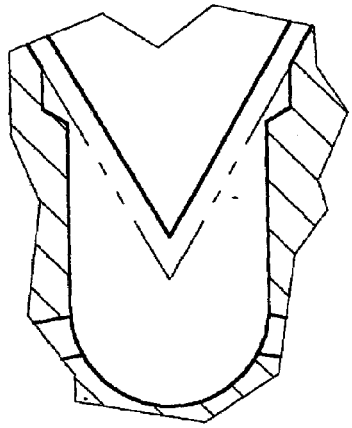
FIG. 5 (prior art)
FIG. 5 is a view similar to FIG. 3, and on the same scale, showing a variant of the structure seen in FIG. 3.
Figure 6:
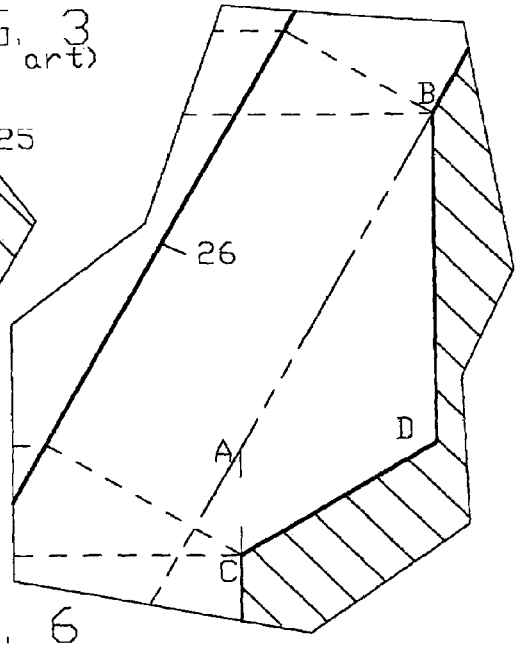
FIG. 6 (prior art)
FIG. 6 is a fragmentary view showing part of the structure seen in FIG. 5.

As also stated above, an alternative prior-art practice was to increase the seat/orifice ratio by boring the top end of the sac with a 120° counter-bore. Such modification of the structure shown in FIGS. 1–4 is shown in FIGS. 5 and 6. The counter-bore intersects the body seat at point B (FIG. 6), this being at the raised altitude referred_to above, and forms an annular notch extending from point B to a second point, C, located in the sac wall below the now-imaginary circular intersection denoted by point A in FIG. 6. The counter-bore forms an annular notch that has a lowest wall CD whose angle-to-vertical, where such wall approaches point C (as well as at other parts of the length of such wall), is half of 120°, or 60°. Such angle-to-vertical is of course substantially less than the angle-to-vertical of the body seat seen in FIGS. 5 and 6.

The height of the raised altitude referred to above is limited by the fact that the contact area between the nozzle valve and the body seat determines the stress to which the body seat is subjected during seating action at the end of injection. Therefore, the level to which the top end of the notch, or the point B referred to above, may be raised must be determined by assessing the body seat stress generated by the impact of the nozzle valve during its most adverse closing action.

The distance of point C below point A is selected to be great enough that the illustrated sweep line associated with point C is enlarged such that there is little or no more restriction of flow past the latter sweep line at the bottom of the notch than there is past the illustrated sweep line associated with point B at the top of the notch. The enlargement of the lower sweep line as compared to the upper one compensates, so to speak, for the reduction of the sweep radii associated with the lower sweep line as compared with the sweep radii associated with the upper sweep line so that the flow areas associated with points B and C are equal or differ by little. The increase in seat/orifice ratio realized by this structure is as great as the increase realized by simply enlarging the sac diameter as described above, but without the relatively severe emissions-increasing drawbacks of the latter.

While this modification increased seat/orifice ratio while somewhat minimizing the increasing of sac volume, it did nothing to reduce sac volume and improve emissions performance in that way. Moreover, even had sac volume been reduced, as by foreshortening the sac, the configuration of the notch was such as to limit to some degree the effectiveness of such foreshortening in reducing emissions.

The present invention contemplates reduction of sac volume by foreshortening of the sac. The present invention also involves annularly notching the body seat and sac wall to increase the seat/orifice ratio. However, according to the present invention, the notch is configured so that it detracts from the effectiveness of the foreshortening of the sac to a much lesser degree than the configuration of FIGS. 5 and 6 would have even if the sac of FIGS. 5 and 6 had been foreshortened, or at least to a somewhat lesser degree, depending on the specific novel notch configuration selected.

Figure 8:
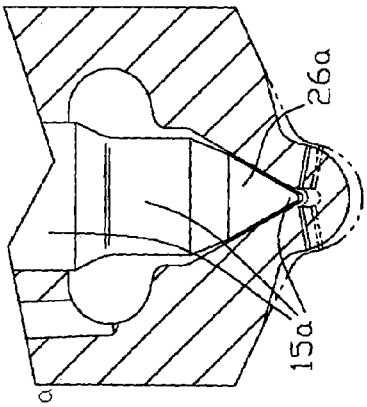
FIG. 8 is a view on an enlarged scale of the lower part of the nozzle seen in FIG. 7, and further illustrating in phantom for comparison purposes certain parts of the structure shown in FIG. 2.
Figure 9:
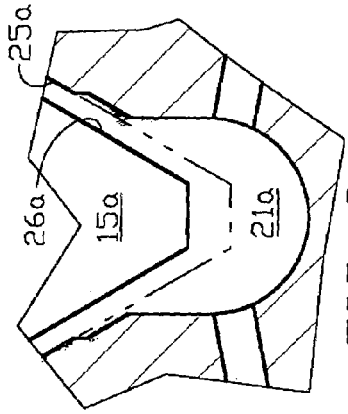
FIG. 9 is a view on a further enlarged scale of the sac seen in FIG. 8 together with adjacent elements or portions thereof.

According to the present invention, and as best seen in FIGS. 8 and 9, a sac 21*a* is provided that is foreshortened from the sac 21 of FIG. 3 or the sac of FIG. 5. The bottom of the foreshortened sac 21*a* is raised to a minimum altitude that is at least high enough that the sac bottom is no greater distance below the imaginary apex of the conical bottom face 26*a* of the nozzle valve 15*a*, when the valve is in seated or closed position, than a quarter of the sac radius. The sac may be raised further so that the sac bottom is at higher altitudes than such minimum altitude, always assuming that there is sufficient clearance between the tip of the valve 15*a* and the bottom of the sac when the valve fully closes.

Preferably the conical bottom face of the nozzle valve 15*a* is truncated at the valve tip as shown in FIG. 9, thus contributing to such sufficiency of clearance. The illustrated truncation aids in preventing the valve from striking the bottom of the sac during operation, and helps assure that sufficient clearance is maintained even after the body seat is ground down incident to reconditioning.

A distinctive aspect of the present invention is the employment of one of a range of forms of notch in the body seat and sac wall that are of different shape than the notch of FIGS. 5 and 6. Three examples of notches within such range of forms are best seen in FIGS. 9–12, one of the three being seen in FIG. 10, a second of the three in FIGS. 11 (and 9), and the third of the three in FIG. 12. Like the notch of FIGS. 5 and 6, all of these three examples comprise a notch extending from a first point in the body seat (point B) above the imaginary intersection A to a second point in the sac wall (point C) below the imaginary intersection A, and all these three examples have a lowest notch wall broadly corresponding to the lowest notch wall CD of FIG. 6. However, unlike the latter, the lowest notch wall of each of the three examples has an angle-to-vertical that is reduced to less than 60° where the wall approaches such second point (point C). Thus, the lowest notch walls CD' of FIG. 10, CD" of FIG. 11, and CB of FIG. 12 have angles-to-vertical where they approach point C that are reduced from the 60° of the lowest notch wall CD of FIG. 6 to 45°, 30°, and approximately 24°, respectively, representing reductions of 15°, 30°, and approximately 36°, respectively from the 60° angle-to-vertical of the lowest notch wall CD of FIG. 6.

Figure 12:
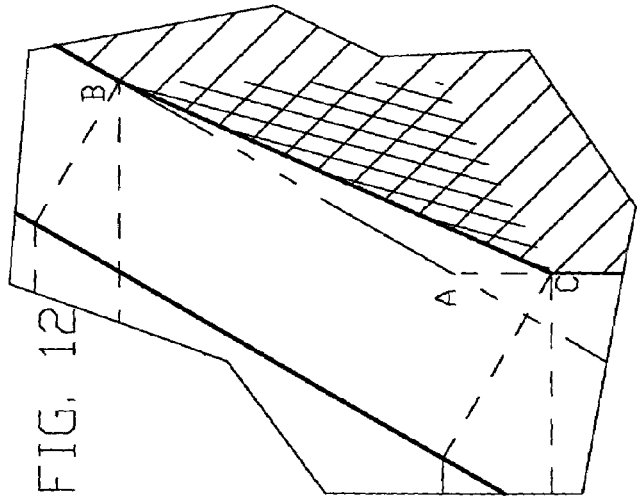
FIGS. 10–12 are views on a still further enlarged scale as compared to FIG. 9.
Figure 11:
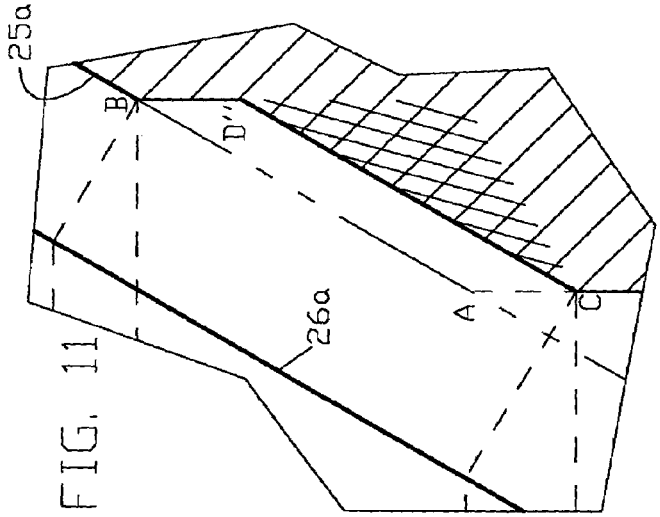

It may be noted that in the construction of FIGS. 9 and 11 the angle-to-vertical of the lowest notch wall CD" is as small as the angle-to-vertical of the body seat 25*a* at point B. In the construction of FIG. 12, the angle-to-vertical of the lowest (and only) notch wall CB is smaller than the angle-to-vertical of the body seat at point B. In these and other figures, the angle-to-vertical of the body seat and the complementary bottom face of the valve is shown at 30° since it is customary to use 60° body seats in injectors of the ALCO type.

Figure 10:
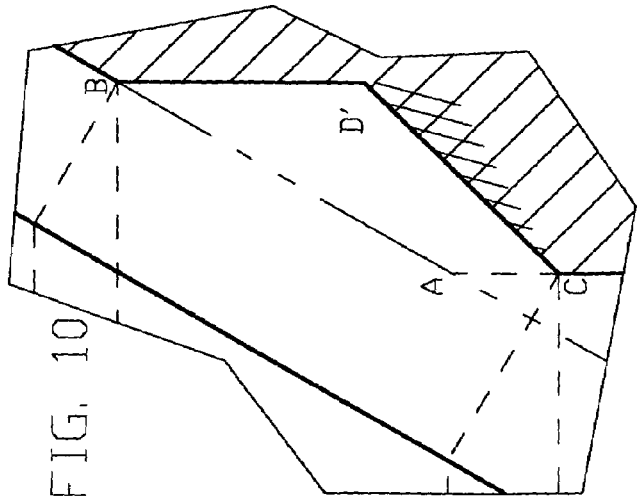

The cross-hatched areas seen in the examples of FIGS. 10–12 represent portions of sac that, as compared to the sac of FIG. 6, have been removed or "filled in," so to speak, incident to such reductions of 15°, 30° and approximately 36°, and have thereby been eliminated as parts of overall sac cross-sectional area. As suggested by the lower limit of the cross-hatching in each of FIGS. 10–12, such removed or filled-in (cross-hatched) areas, had they not been removed or filled in, would have been bounded in part by a lower notch wall having an angle-to-vertical of 60°, similarly to the lower notch wall CD of FIG. 6.

Significantly, of all parts of the cross-sectional area of the sac, such cross-hatched areas would have had greater sweep-area radii than most parts, had such cross-hatched areas not been removed or filled-in. This means that for reduction of sac volume their removal is more significant than removal of parts of the sac cross-sectional sac area of the same magnitude but located nearer the nozzle axis.

(The radius of any specific solid-of-revolution-generating part of a cross-sectional area is the distance from the centroid or center of gravity of such specific part to the axis of revolution around which the part is swept to generate volume. In this case the axis of revolution is of course the central axis of the nozzle. The centroid of a triangular area is the intersection of lines drawn from each apex to the midpoint of the side opposite the apex.)

For example, assume a nozzle that has functional points or edges generally corresponding to points A–C mentioned above. Assume such nozzle uses a 60° body seat (body seat angle-to-vertical of 30°) and has a sac radius of 0.89 mm, a radius at the top of the notch (i.e., at point B) of 1.11 mm, a lift of 0.38 mm, with the valve tip truncated to 0.50 mm above its imaginary apex, the bottom of the sac lying at the imaginary apex of the valve when the valve is closed, and the point C located below the point A just far enough (about 0.12 mm) that the area of flow past point C is as great as the flow area past point B when the valve is fully opened.

If such a sac is configured with a lower notch wall having an angle-to-vertical of 60° (as in a 120° counter-bore such as shown in FIGS. 5 and 6), its overall sweep area (including the notch) when closed is 0.61 $mm^2$ and the sac's volume (including the notch) is 2.21 $mm^3$. If the notch is modified to be as the notch shown in FIG. 11 so that the lower notch wall has an angle-to-vertical of 30° (corresponding to a 60° counter-bore) to thereby form a parallelogram (such parallelogram having two relatively short vertical sides AC and BD" and also having two relatively long slanted sides AB and CD" that have the same angle-to-vertical as the body seat), the overall sweep area of the sac is reduced from the foregoing 0.61 $mm^2$ by 4.6% (to 0.58 $mm^2$) but sac volume is reduced from the foregoing 2.21 $mm^3$ by 8.2% (to 2.03 $mm^3$).

Or, if the notch is modified so that the lower notch wall has an angle-to-vertical of about 24° to form a chamfer, as in FIG. 12, the overall sweep area of the sac is reduced from the foregoing 0.61 $mm^2$ by 6.8% (to 0.57 $mm^2$) but sac volume is reduced from the foregoing 2.21 $mm^3$ by 12.1% (to 1.94 $mm^3$).

While the reduction in sac volume of about 12% as just described in the second example above is obviously to be preferred to a reduction of about 8% in the first example, there may be trade-offs to consider in choosing between such alternatives. For example, manufacturing tooling costs may be significantly higher in shaping the chamfer seen in FIG. 12 as against shaping the counter-bore seen in FIG. 11 (or the one seen in FIG. 10). Considering all factors, use of a counter-bore such as shown in FIG. 11 appears to be the actual choice of preference in at least one present potential commercial application.

While reductions in sac volume to the extent of 8% or 12% as described in the above examples are particularly significant, it will be appreciated that any reduction below 60° of the angle-to-vertical of the bottom of a body seat notch is advantageous, because whatever percentage reduction in sweep area is thereby realized, the percentage reduction of overall sac volume will be substantially greater.

It will be appreciated that in all these examples the reductions in sac volume may be and preferably are accomplished without increasing the restriction of flow past the body seat, as by proper selection of the distance AC in structures such as those illustrated in FIGS. 10–12.

It follows from the foregoing descriptions that in each of the various annularly notched nozzles to which FIGS. 5–12 relate, the nozzle has the following attribute: when the associated valve is in fully raised position, the nozzle provides a given minimum cross-sectional flow area for fluid passing from the associated injection nozzle chamber to the associated sac, which minimum flow area is greater than the minimum flow area associated with an otherwise identical nozzle that does not have such annular notching. For example, the notched prior-art nozzle of FIGS. 5 and 6 has a given minimum cross-sectional flow area that is greater than that of the nozzle of FIGS. 1–4, the latter nozzle being identical to the nozzle of FIGS. 5 and 6 except that the nozzle of FIGS. 1–4 is not annularly notched. (Nozzles similarly identical to the nozzles of FIGS. 7–12 save only for lack of annular notches are not specifically illustrated but can be readily visualized.)

Since the attribute described in the preceding paragraph is shared by some prior-art nozzles, such as the nozzle of FIGS. 5 and 6, such attribute is not itself a novel feature of the present invention. However such attribute is presently set forth to provide an explicit basis for part of the contextual language used in the accompanying claims.

Figure 7:
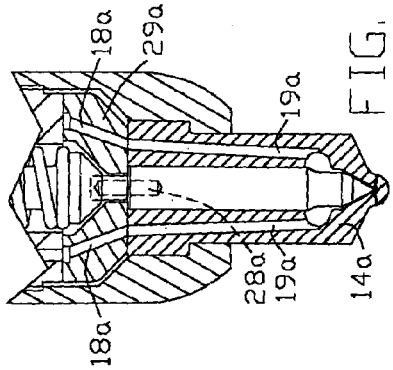
FIG. 7 is a broken-away cross-sectional view similar to the lower part of FIG. 1 and on the same scale, but showing the lower part of a nozzle embodying the invention, although the scale of the respective drawings is such that some of the differences between the respective devices are not visible in these views.

In the modified nozzle seen in FIG. 7 fuel ducting is modified in such a way as to reduce parasitic volume of the fuel delivery system and thereby contribute to increasing injection pressure at the nozzle orifices, further enhancing engine performance. In the modified nozzle seen in FIG. 7, the three ducts 18 of the valve stop spacer 29 of FIG. 1 (which are spaced 120 degrees apart, and only one of which is seen) are replaced by the two diametrically opposed ducts 18*a* in valve stop spacer 29*a*, the annular groove 13 in the upper face of the nozzle body 14 of FIG. 1 is eliminated in the nozzle body 14*a*, and the four ducts 19 (two diametrically opposed pairs, one pair not visible) of the nozzle body 14 of FIG. 1 are replaced by the two diametrically opposed ducts 19*a* in the nozzle body 14*a*. The valve stop spacer 29*a* and nozzle body 14*a* of FIG. 7 are pinned together by dowel pin 28*a* and a second diametrically opposed pin (not seen because above the plane of FIG. 7), thereby positively aligning the fuel passages 18*a* and 19*a* and eliminating need for a groove similar to annular groove 13 seen in FIG. 1. The diametrically opposed dowel pin 28*a* and its non-illustrated companion are at the same locations around the nozzle body 14*a* as the two eliminated ducts 19 were around the nozzle body 14.

In the modified nozzle of the invention, the total nozzle orifice area and the preceding flow area through the valve seat, as modified, require no more flow passage area in the nozzle body than provided by pairs of ducts of the original size, rather than the sets of four used in the ALCO-type design.

Parasitic volume allows more fuel to be stored in the total volume of a system during fuel delivery by the injection pump due to compressibility of fuel under pressure, thereby reducing the maximum pressure that can be achieved with a smaller system volume (providing flow area is adequate). Reducing the volume at the nozzle end of the system as just described has the effect of raising the injection pressure in the sac at the nozzle orifices, resulting in greater spray penetration and improved spray dispersion. These improvements are fully compatible with the notched-body valve improvements described above, and further contribute to the overall performance of the modified ALCO-type nozzles provided by the invention.

References herein to sac diameter or radius generally refer to the diameter or radius of the cylindrical upper portion of the sac proper, and not to greater diameters or radii that may be associated with edges or walls of notches formed in the body seat.

Valve seats and corresponding body seats are referred to above as complementary to each other; however "complementary" is intended to include the relationship whereby the included angle of the valve seats very slightly exceeds that of the corresponding body seats in order to better establish the sealing locations at the top of the valve seats in accordance with accepted practice, the valve seats and body seats remaining however complementary to each other in a general sense.

The invention is not to be limited to details of the disclosure, which are given by way of example and not by way of limitation. For example, there may be filleting between the pairs of solid notch sides BD" and CD" seen in FIG. 11, instead of the defined corners that are shown. Also, the exterior surface that is formed as an inverted dome at the lower extremity of the injector is shown (in FIG. 8) as centered on the same center as is the sac bottom, but instead the center of the dome radius may be spaced below the center of the sac-bottom radius, such spacing amounting to as much as 25% or more of the sac-bottom radius. Many other changes of similar nature are possible within the scope of the invention.

What is claimed is:

1. In a diesel injection nozzle-and-holder assembly, a nozzle comprising a nozzle body, a nozzle body chamber formed in said body, a sac below said nozzle body chamber, upper parts of the wall of said sac lying in an imaginary cylindrical surface, an open-centered body seat at the bottom of the body chamber, lower parts of said body seat lying in an imaginary conical surface that is coaxial with said imaginary cylindrical surface, said imaginary cylindrical and conical surfaces intersecting each other at an imaginary circular intersection, a plurality of injection orifices in said sac spaced below said body seat and opening from said sac to the exterior of said injection nozzle, a valve extending through the body chamber and having a bottom face including a conical face portion generally complementary to said body seat and having a given included angle, said valve being movable to a seated position in sealing relation against said body seat to cut off fluid flow to said sac, a spring urging said valve to said seated position, said valve having a differential-area portion exposed to said nozzle body chamber whereby the valve is urged upwardly from said seated position through a given lift distance to a full-lift position, said upward urging being by hydraulic pressure in said chamber and being against the bias of said spring, an annular notch extending from a first point in said body seat above said imaginary circular intersection to a second point in said sac wall below said imaginary circular intersection, said notch having a lowest wall that is at a given angle-to-vertical where said lowest wall approaches said second point, said nozzle, in said fully raised position of said valve, providing a given minimum cross-sectional flow area for fluid passing from said injection nozzle chamber to said sac greater than that associated with an otherwise identical nozzle that does not have such annular notching, the improvement wherein said given angle-to-vertical of said lowest notch wall where it approaches said second point is reduced to less than 60°, whereby sac cross-sectional areas that would have been bounded in part by a lowest notch wall having an angle-to-vertical of 60°, and which, of all parts of the cross-sectional area of the sac, would have had relatively great sweep area radii with reference to said nozzle's central axis, stand eliminated, and the percentage of reduction of sac volume that is realized incident to such angle reduction is higher than the percentage by which sweep area is reduced.

2. A device as in claim 1 in which the angle-to-vertical of said lowest notch wall is reduced to 45° or less.

3. A device as in claim 2 in which the angle-to-vertical of said lowest notch wall approaches being as small as the angle-to-vertical of said body seat at said first point.

4. A device as in claim 2 in which the angle-to-vertical of said lowest notch wall is equal to the angle-to-vertical of said body seat at said first point and said notch shape is that of a parallelogram with two vertical sides and two sides having the same angle-to-vertical as said body seat.

5. A device as in claim 2 in which the angle-to-vertical of said lowest notch wall is smaller than the angle-to-vertical of said body seat at said first point.

6. A device as in claim 5 in which the angle-to-vertical of said lowest notch wall is sufficiently small that said lowest notch wall is the only notch wall and the notch has the form of a chamfer.

* * * * *